US006337626B1

(12) United States Patent
Huang

(10) Patent No.: US 6,337,626 B1
(45) Date of Patent: Jan. 8, 2002

(54) USER RECOGNITION SYSTEM

(76) Inventor: Dennis Huang, 5F, No. 10, Lane 9, Ningpo E. St., Taipei (TW)

( * ) Notice: Subject to any disclaimer, the term of this patent is extended or adjusted under 35 U.S.C. 154(b) by 0 days.

(21) Appl. No.: 09/625,182

(22) Filed: Jul. 25, 2000

(51) Int. Cl.[7] ..... G08B 13/00
(52) U.S. Cl. ..... 340/541; 340/10.1
(58) Field of Search ..... 340/541, 572.1, 340/545, 501, 500, 10.1, 426; 341/176

(56) References Cited

U.S. PATENT DOCUMENTS 5,621,385 A * 4/1997 Carney ..... 340/541
5,808,547 A * 9/1998 Carney ..... 340/541
6,057,764 A * 5/2000 Williams ..... 340/541
6,075,294 A * 6/2000 Van den Boom et al. .. 340/541

* cited by examiner

*Primary Examiner*—John A. Tweel, Jr.
(74) *Attorney, Agent, or Firm*—Bacon & Thomas PLLC

(57) ABSTRACT

A user recognition system used in a restricted area. The system including a first alert status check when a legal or an illegal user enters the restricted area. The system includes a second alert status when the user or illegal user leaves the restricted area. The receiver continuously detects the recognition signal transmitted by the transmitter carried by the legal user during the first alert status, so as to judge if the legal user is in the restricted area or not.

7 Claims, 4 Drawing Sheets

USER RECOGNITION SYSTEM

BACKGROUND OF THE INVENTION

1. Field of the Invention

The present invention relates to a radio burglar alarm apparatus, and more specifically to a user recognition system, that can actively and continuously detect the status of operation of the system.

2. Description of the Related Art

Regular system recognition devices for use in a management system, for example, a motor vehicle burglar alarm system, commonly adopts a passive type single recognition method to recognize the code signal, i.e., the user uses a remote controller to directly activate/deactivate the vehicle burglar alarm. When the ON function is selected, the vehicle door lock is opened, enabling the vehicle engine to be started (the vehicle engine is unlocked at this time). When the OFF function is selected, the vehicle door lock and the vehicle engine are locked, and the alarm will be triggered if a vibration is detected. Because the passive type single recognition method is adopted, even if a hopping technique is employed, the system recognition device can easily be copied.

Lately, various vehicle positional systems were developed. However, these vehicle positional systems are still not safe in use because they adopt the same passive type single recognition method.

Further, if the user forgets to press the remote controller, the alarm of the vehicle burglar alarm system or vehicle positional system may be triggered accidentally, or the vehicle burglar alarm system or vehicle positional system may not be started.

SUMMARY OF THE INVENTION

The present invention overcomes the drawbacks of the prior art. One object of the present invention is to provide a user recognition system, which actively and continuously runs a recognition action. Another object of the present invention is to provide a user recognition system, which is capable of matching with surrounding resources to run a multiplex recognition action. Yet another object of the present invention is to provide a user recognition system, which provides two alert status for use when the user is in or not in a restricted area.

According to the present invention, the user recognition system comprises at least one transmitter, and a receiver. Each transmitter is carried by an individual user. The receiver is installed in the object (apparatus) to be detected and recognized. By means of matching the transmitter and the receiver with the object (apparatus), or the object (apparatus) with surrounding resources, the present invention provides two alert status. When an individual user carries one transmitter, approaches and uses the object or apparatus (restricted area) in which the receiver is installed, the system enters the first alert status.

When in the first alert status, the transmitter and the receiver actively and continuously run the recognition action, and the receiver immediately gives an alarm or SOS signal upon interruption of the receiving of the signal from the transmitter.

When the user leaves the object or apparatus in which the receiver is installed, the system enters the second alert status, and the receiver can match with the surrounding resources provided by the object or apparatus to give an alarm or SOS signal upon the occurrence of an abnormal condition.

The user recognition system can be used in our daily life, for example, the system can be used in a vehicle or building security system, or a computer user control system.

DETAILED DESCRIPTION OF THE PREFERRED EMBODIMENT

Figure 1:
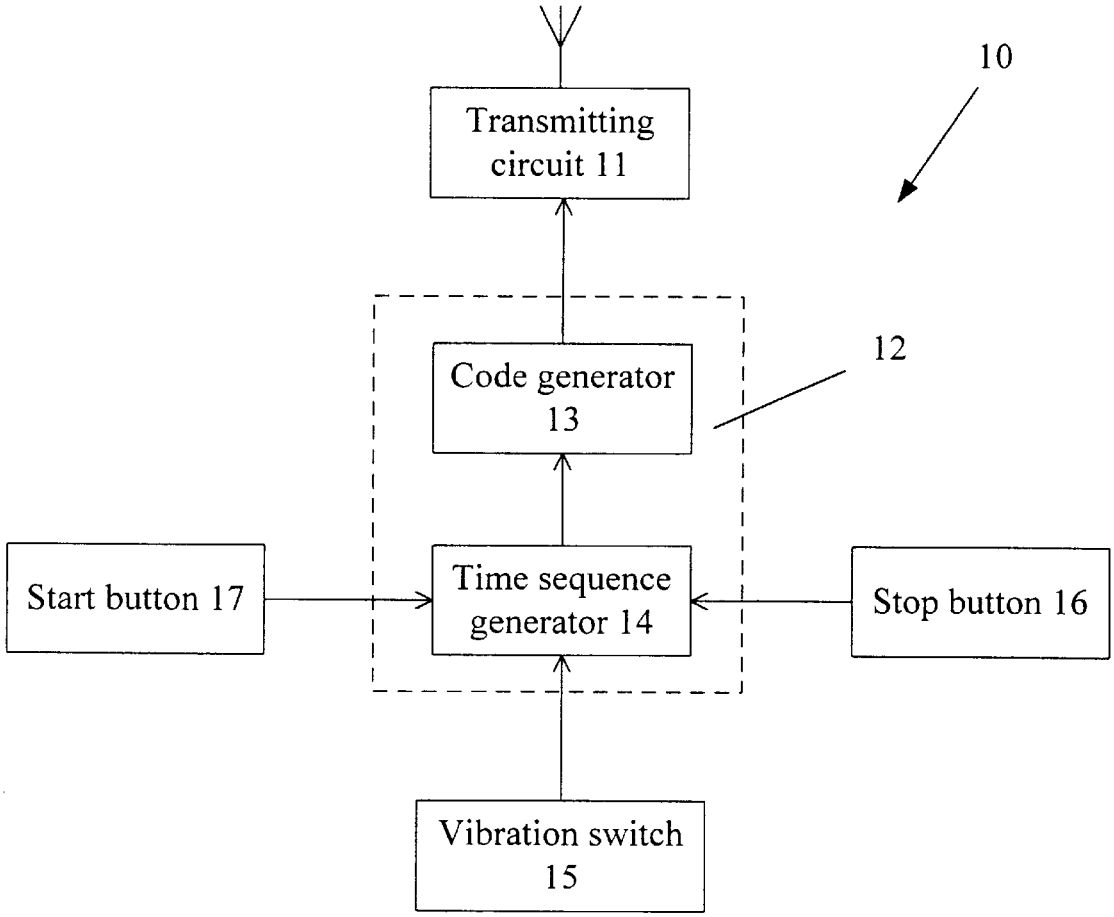
FIG. 1 is a circuit block diagram of a transmitter for a user recognition system according to the present invention.
Figure 2:
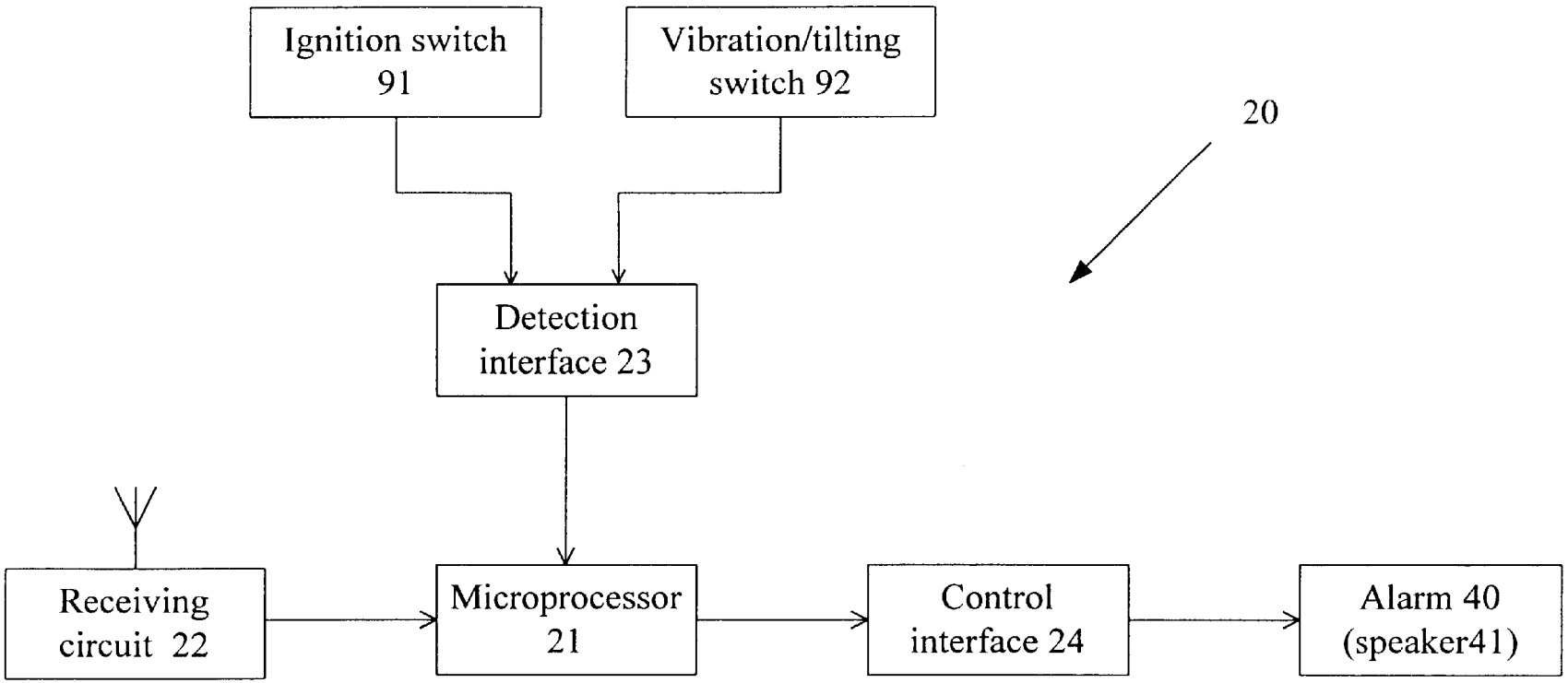
FIG. 2 is a circuit block diagram of a receiver for a user recognition system according to the present invention.

Referring to FIGS. 1 and 2, a user recognition system in accordance with the present invention is generally comprised of a transmitter 10, and a receiver 20. For easy understanding of the present invention, the preferred embodiment of the present invention is explained for use in a motor vehicle, In this case, the transmitter 10 is carried by the user, and the receiver 20 is installed in the motor vehicle.

The transmitter 10 comprises a transmitting circuit 11, and a transmitting control circuit 12, a vibration switch 15, and a stop button 16.

The transmitting circuit 11 has signal modulation and transmitting functions, and continuously produces a recognition signal and transmits the recognition signal into the air by radio. Because this radio transmitting technique is of the known art, it is not described herein in detail.

The transmitting control circuit 12 (that can be a microprocessor) comprises a code generator 13 and a time sequence generator 14. The code generator 13 generates a code (that can be a fixed code or variable code), enabling the code to be transmitted with the signal. The time sequence generator 14 continuously controls the transmitting circuit 11 to transmit radio waves at a fixed time (for example 10 seconds or irregular time intervals).

The vibration switch 15 can be a mercury switch or solenoid switch connected to the transmitting control circuit 12 to detect the vibration of the transmitter 10. When no vibration is detected within a predetermined length of time, the vibration switch 15 immediately switches off the transmitting control circuit 12, thereby causing the transmitting circuit 11 to stop the transmitting of the recognition signal.

The stop button 16 is connected to the transmitting control circuit 12. When clicked, the stop button 16 provides a stop signal to the transmitting control circuit 12, thereby causing the transmitting circuit 11 to transmit the stop signal with the recognition signal to the receiver 20. Upon receipt of the stop signal, the receiver 20 immediately stops the operation. For example, when the motor vehicle is used during an emergency, the user (car owner) switches off the system, preventing recognition errors.

The receiver 20 is installed in the motor vehicle to be protected, comprised of a microprocessor 21, a receiving circuit 22, a detection interface 23, and a control interface 24.

The microprocessor 21 processes signal transmitted from the receiving circuit 22 or the detection interface 23, and drives the control interface 24 to work subject to the nature of the signal received.

The receiving circuit 22 receives the radio wave signal transmitted from the transmitter 10, then demodulates the signal, and then sends the demodulated signal to the microprocessor 21, causing the microprocessor 21 to work subject to the nature of the signal received. Because the radio signal receiving technique is of the known art, it is not described herein in detail.

The detection interface 23 receives signal transmitted from the restricted area (for example, the inside of the motor vehicle). Upon receipt of signal, the detection interface 23 informs the microprocessor 21 to enter a first or second alert status, or detects the restricted area (this will be described further).

The control interface 24 is controlled by the microprocessor 21 to output a control signal to the outside for controlling an external apparatus, for example, a speaker to produce sound (this will be described further).

Figure 3:
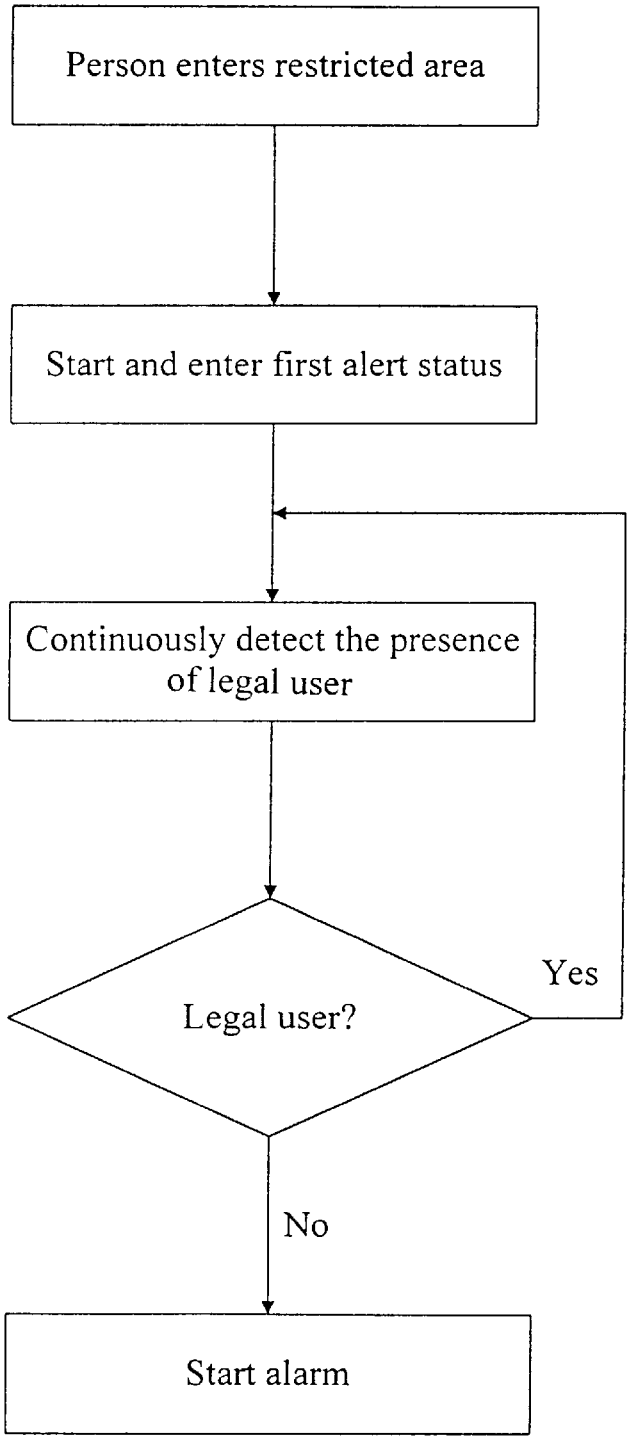
FIG. 3 is a flow chart explaining the operation of the present invention at the first alert status.

Referring to FIGS. 1–3, the detection interface 23 is connected to the ignition switch 91 of the motor vehicle by an electric wire. When the user enters the motor vehicle and starts the ignition switch 91, a start signal is transmitted from the ignition switch 91 to the detection interface 23, thereby causing the microprocessor 21 to drive the receiver 20 into a first alert status. This first alert status occurs when the user or any other person enters the restricted area (for example, the inside of the motor vehicle).

It is to be understood that many detection apparatus or methods could be employed for enabling the receiver 20 to enter the first alert status. For example, the apparatus for triggering a start signal can be a safety belt switch in the motor vehicle, a computer in the motor vehicle, a generator in the motor vehicle, or the driver seat of the motor vehicle. When a person enters the motor vehicle and uses the apparatus, a start signal is triggered.

When entering the first alert status, the receiver 20 starts to receive the recognition signal from the transmitter 10, enabling the received recognition signal to be by the microprocessor 21. When the signal is recognized (for example, the code is recognized), and/or the recognition signal is received at the set time interval, for example, 10 seconds; the recognition signal will be rejected if it is not received at the set time interval), the receiver 20 is maintained in the receiving status. If the receiver 20 receives no signal after entering the first alert status, or the received signal is rejected, the microprocessor 21 drives the control interface 24 to provide a control signal to an alarm device 40, causing it to output an alarm signal.

The alarm device 40 can be a speaker 41, a flasher (directional or signal light), high voltage discharging apparatus, oil loop breaker, smoke generator, automatic dialer (to dial the telephone of a security organization or company), a tracer, etc. The alarm device 40 can be built in the receiver 20.

If the transmitter 10 detects no vibration within the set time, it automatically turns off the transmitting control circuit 12, causing the transmitting circuit 11 to stop the transmission of the recognition signal. If the transmitter 10 is lost in the motor vehicle, for example, left under the seat in the motor vehicle, and an intruder enters the motor vehicle to start the ignition switch 91 at this time, the receiver 20 is induced and enters the first alert status, however because the transmitter 10 is stopped from sending the recognition signal, the alarm device 40 will operate.

Figure 4:
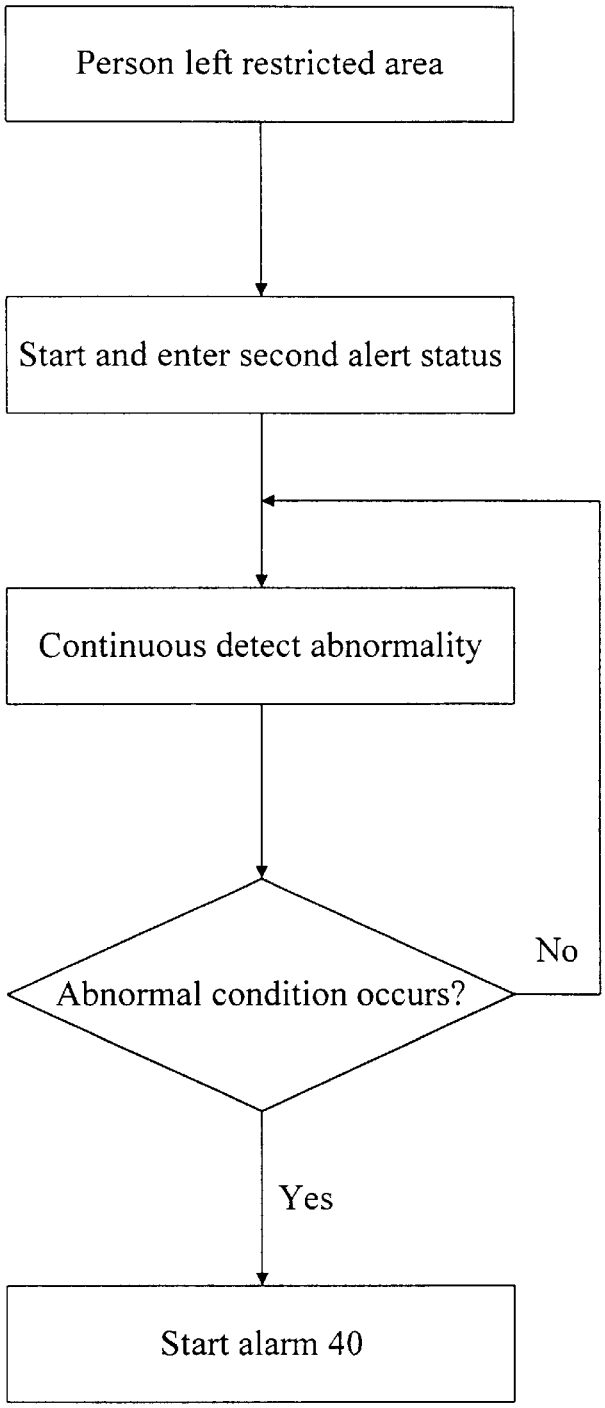
FIG. 4 is a flow chart explaining the operation of the present invention at the second alert status.

Referring to FIGS. 1, 2 and 4, when the user switches off the ignition switch 91 and leaves the motor vehicle, the detection interface 23 immediately detects a second start signal from the off status of the ignition switch 91, at this time the microprocessor 21 controls the receiver 20 to enter a second alert status. This second alert status is used when the user or any person who entered the motor vehicle leaves the restricted area (the motor vehicle).

In the example where the restricted area is a motor vehicle, a vibration/tilting switch 92 (sensor means) is installed in the motor vehicle and connected to the detection interface 23. If the motor vehicle is vibrated or moved during the second alert status, the vibration/tilting switch 92 transmits a guard signal to the microprocessor 21 through the detection interface 23, causing the microprocessor 21 to output a control signal to the alarm device 40 through the control interface 24, and therefore the alarm device 40 is triggered to alarm. A variety of sensor means may be installed in the motor vehicle at different locations, and connected to the detection interface 23.

The receiver enters the second alert status "automatically" when the detection interface 23 detects non-presence of the user or any other person in the restricted area. A start button 17 may be installed in the transmitter 10 for operation by the user to drive the transmitting circuit 11 after leaving the motor vehicle, causing the transmitting circuit 11 to transmit a second start signal to the microprocessor 21 of the receiver 20, so as to drive the receiver 20 into the second alert status.

When in the first or second alert status, the system is maintained at the automatic, active, and continuous recognition detection status, and the user needs to pay attention to the management of the system. By means of the application of random coding and a stop button, the recognition accuracy of the system is greatly improved.

It is to be understood that the drawings are designed for purposes of illustration only, and are not intended for use as a definition of the limits and scope of the invention disclosed.

What the invention claimed is:

1. A user recognition system for use in a restricted area, said user recognition system having a first alert status which is activated when a legal user or an illegal user enters said restricted area, and a second alert status which is activated when the legal user or illegal user leaves said restricted area, said user recognition system being used with a detector device installed in said restricted area to detect the presence of the user or an illegal user in said restricted area, so as to activate said first alert status or said second alert status, said user recognition system being also used with a guard sensor device to detect an abnormality of said restricted area when in said second alert status, said user recognition system comprising:

at least one transmitter each comprising a transmitting circuit for producing a recognition signal and transmitting said recognition signal into the air by radio, and a transmitting control circuit, said transmitting control circuit comprising a code generator for producing a code signal for transmitting with said recognition signal into the air by radio by said transmitting circuit, and a time sequence generator for controlling said transmitting circuit to transmit said recognition signal and said code signal continuously at a predetermined interval;

a receiver comprising a microprocessor for processing and controlling the component parts in said receiver, a receiving circuit for receiving and demodulating said recognition signal from said transmitter, a detection interface used with said detector device to detect the presence of the user or the illegal user in said restricted area, enabling said microprocessor to select entry of said first alert status or said second alert status, and a control interface through which said microprocessor sends a control signal to an alarm device connected thereto;

wherein when the user recognition system enters said first alert status, said receiver continuously detects the recognition signal from the transmitter carried by the user so as to judge if the legal user is in said restricted area or not, and said microprocessor provides a control signal to drive said alarm device when the legal user is not in said restricted area; and wherein when the user recognition system initiates said second alert status, said receiver does not detect the recognition signal transmitted by said at least one transmitter.

2. The user recognition system of claim 1, wherein said at least one transmitter each further comprises a vibration switch, which turns off said transmitting control circuit when it detects no vibration within a predetermined length of time, causing the respective transmitter to stop transmitting the recognition signal and the code signal.

3. The user recognition system of claim 1, wherein said detection interface of said receiver is connected to said guard sensor device to detect an abnormality of said restricted area when in said second alert status, and to drive said microprocessor to send a control signal to said alarm device through said control interface upon detection of an abnormality in said restricted area.

4. The user recognition system of claim 1, wherein said predetermined interval produced by said time sequence generator is not a fixed time interval.

5. The user recognition system of claim 1, wherein said alarm device is a part of the user recognition system.

6. The user recognition system of claim 1, wherein said at least one transmitter each further comprises a stop button, which when clicked, stops the respective transmitting circuit from transmitting the signal to said receiver, so as to stop said microprocessor from sending said control signal to said control interface.

7. The user recognition system of claim 1, wherein said restricted area is a motor vehicle.

* * * * *